US008550680B2

(12) United States Patent
Kim

(10) Patent No.: US 8,550,680 B2
(45) Date of Patent: Oct. 8, 2013

(54) LIGHTING DEVICE

(75) Inventor: Dong Soo Kim, Ansan-si (KR)

(73) Assignee: LG Innotek Co., Ltd., Seoul (KR)

( * ) Notice: Subject to any disclaimer, the term of this patent is extended or adjusted under 35 U.S.C. 154(b) by 583 days.

(21) Appl. No.: 12/844,534

(22) Filed: Jul. 27, 2010

(65) Prior Publication Data

US 2011/0026238 A1 Feb. 3, 2011

(30) Foreign Application Priority Data

Jul. 28, 2009 (KR) ..... 10-2009-0068924

(51) Int. Cl.
*F21V 7/04* (2006.01)

(52) U.S. Cl.
USPC ..... 362/549; 362/249.01; 362/217.01

(58) Field of Classification Search
USPC ..... 362/549, 249.01, 217.01, 217.1, 362/217.11–217.13
See application file for complete search history.

(56) References Cited

U.S. PATENT DOCUMENTS

| | | | | |
|---|---|---|---|---|
| 6,123,441 | A | 9/2000 | Kasboske | |
| 2007/0058377 | A1 * | 3/2007 | Zampini et al. | 362/372 |

FOREIGN PATENT DOCUMENTS

| | | | |
|---|---|---|---|
| CN | 1722484 | A | 1/2006 |
| DE | 20104019 | U1 | 8/2001 |
| KR | 10-2004-0104047 | A | 12/2004 |
| KR | 10-2004-0104048 | A | 12/2004 |
| KR | 10-2007-0097679 | A | 10/2007 |
| KR | 10-0834973 | B1 | 6/2008 |
| KR | 10-2007-044566 | A1 | 3/2009 |
| WO | WO 2009/033992 | A1 | 3/2009 |

* cited by examiner

*Primary Examiner* — Vip Patel
(74) *Attorney, Agent, or Firm* — Birch, Stewart, Kolasch & Birch, LLP

(57) ABSTRACT

Disclosed is a lighting device. The lighting device includes a plurality of lighting units including a housing, a light emitting module installed in the housing, and a coupling part having a fixing section coupled on the housing and a protrusion section horizontally protruding from an upper end of the fixing section; and a bracket having an insertion groove slidably coupled with the protrusion section of the coupling part to assemble the lighting units with each other.

20 Claims, 8 Drawing Sheets

LIGHTING DEVICE

The present application claims priority under 35 U.S.C. §119 (a) of Korean Patent Application No. 10-2009-0068924 filed on Jul. 28, 2009, which is hereby incorporated by reference in its entirety.

BACKGROUND

The embodiment relates to a lighting device.

A light emitting diode (LED) is a kind of semiconductor devices that convert electric energy into light. The LED is advantageous as compared with conventional light sources, such as a fluorescent lamp or a glow lamp, in terms of power consumption, life span, response speed, safety and environmental-friendly requirement.

In this regard, various studies have been performed to replace the conventional light sources with the LEDs. The LEDs are increasingly used as light sources for lighting devices such as liquid crystal displays, electric signboards, street lamps, display lamps, and indoor lamps.

SUMMARY

The embodiments provide a lighting device having a novel structure.

The embodiments provide a lighting device which can be easily assembled and disassembled.

The embodiments provide a lighting device assembled in various layouts such that the lighting device may have various areas suitable for various installation environments.

A lighting device according to the embodiment includes a plurality of lighting units including a housing, a light emitting module installed in the housing, and a coupling part having a fixing section coupled on the housing and a protrusion section horizontally protruding from an upper end of the fixing section; and a bracket having an insertion groove slidably coupled with the protrusion section of the coupling part to assemble the lighting units with each other.

A lighting device according to the embodiment includes a plurality of lighting units including a housing, a light emitting module installed in the housing, and a coupling member coupled with the housing and having an insertion groove; and a coupling bar inserted into an insertion hole, which is defined by insertion grooves of two adjacent coupling members of the lighting units.

A lighting device according to the embodiment includes a plurality of lighting units including a housing formed thereon with an insertion hole, and a light emitting module installed in the housing; and a bracket inserted into the insertion hole of the housing to assemble the lighting units with each other.

DETAILED DESCRIPTION OF THE EMBODIMENTS

Figure 1:
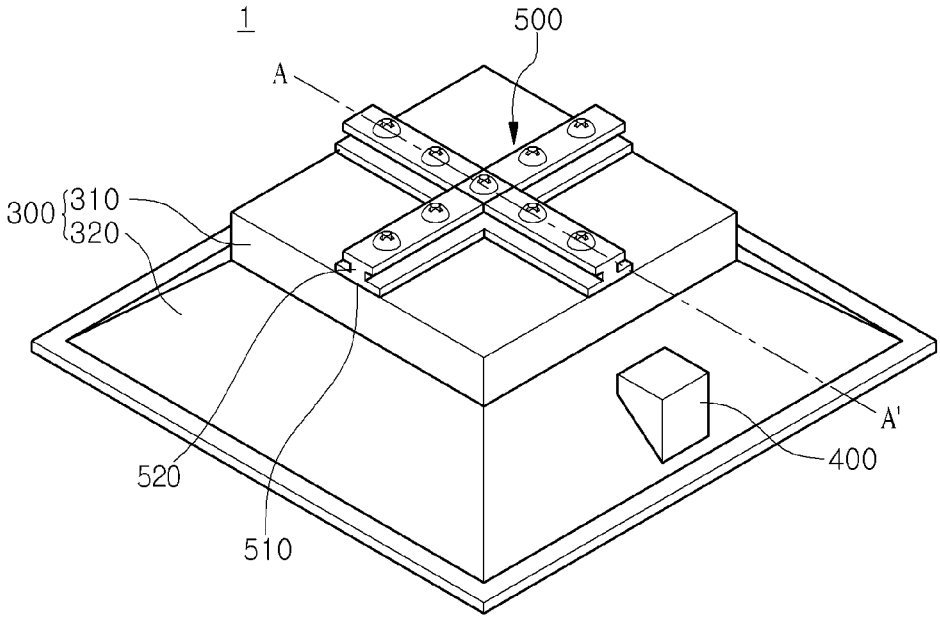
FIG. 1 is a perspective view showing a lighting unit according to the first embodiment.

In the description of the embodiments, it will be understood that, when a layer (or film), a region, a pattern, or a structure is referred to as being "on" or "under" another substrate, another layer (or film), another region, another pad, or another pattern, it can be "directly" or "indirectly" on the other substrate, layer (or film), region, pad, or pattern, or one or more intervening layers may also be present. Such a position of the layer has been described with reference to the drawings.

The thickness and size of each layer shown in the drawings may be exaggerated, omitted or schematically drawn for the purpose of convenience or clarity. In addition, the size of elements does not utterly reflect an actual size.

Hereinafter, a lighting device according to the embodiments will be described in detail with reference to accompanying drawings.

Figure 2:
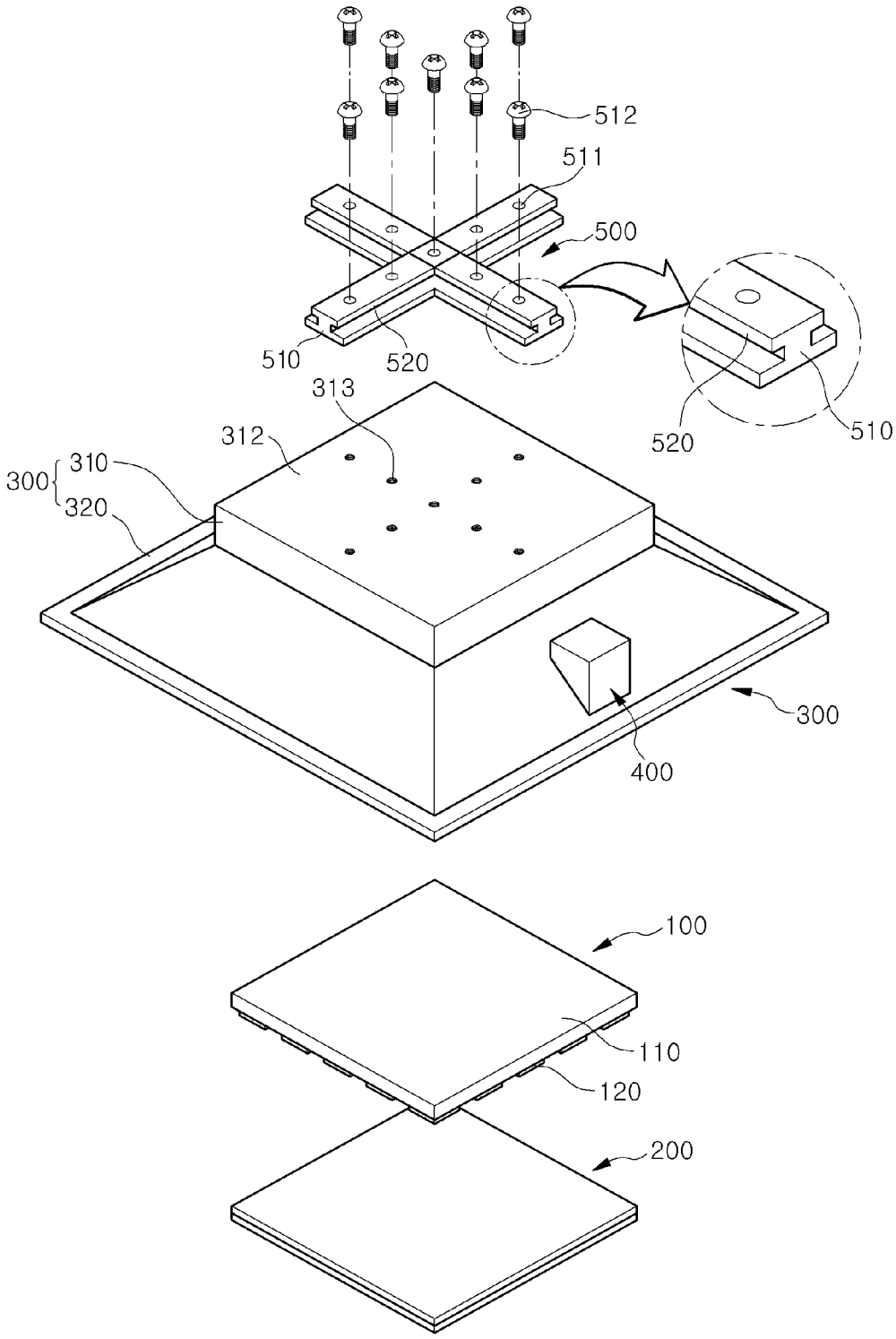
FIG. 2 is an exploded perspective view showing a lighting unit according to the first embodiment.
Figure 3:
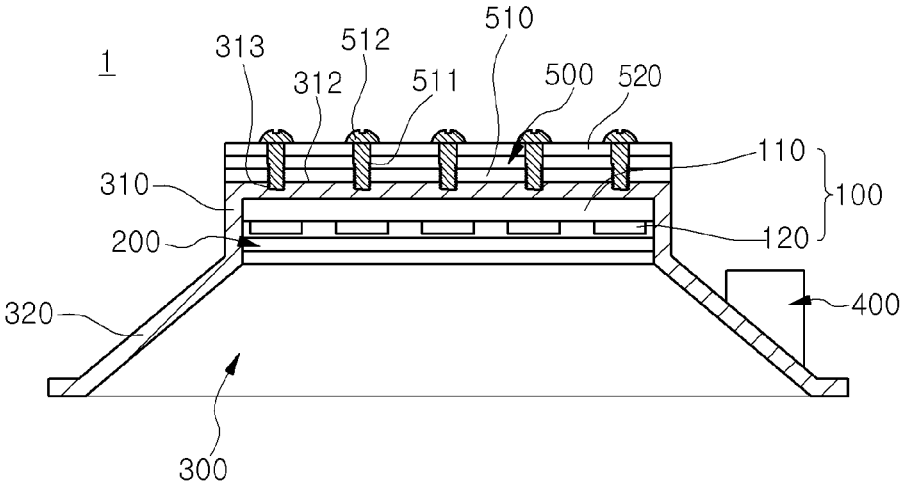
FIG. 3 is a sectional view taken along line A-A' of FIG. 1.
Figure 4:
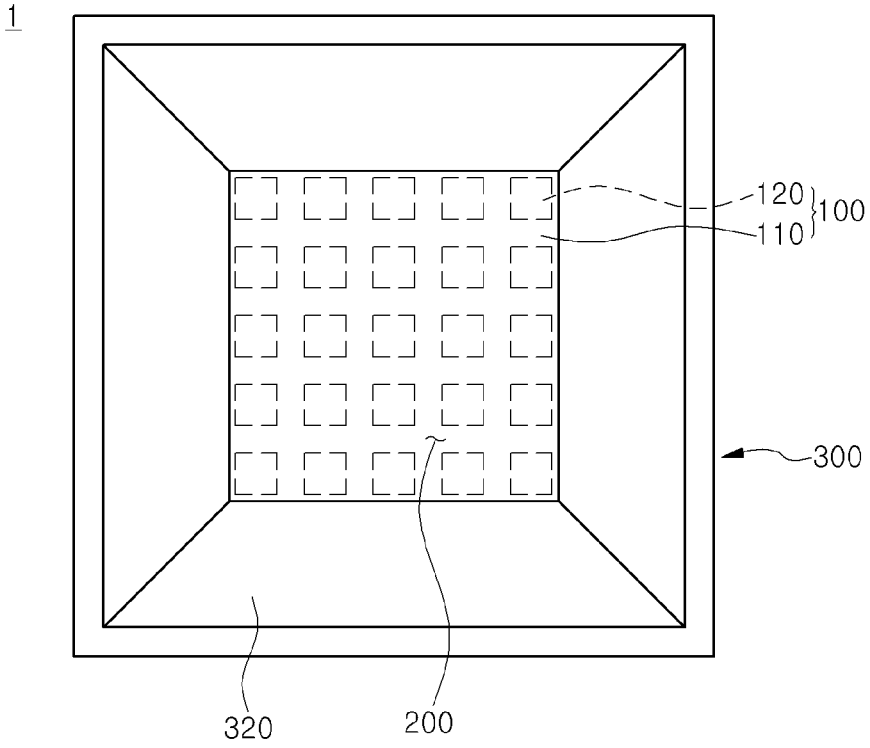
FIG. 4 is a plan view showing an exit surface of a lighting unit according to the first embodiment.
Figure 5:
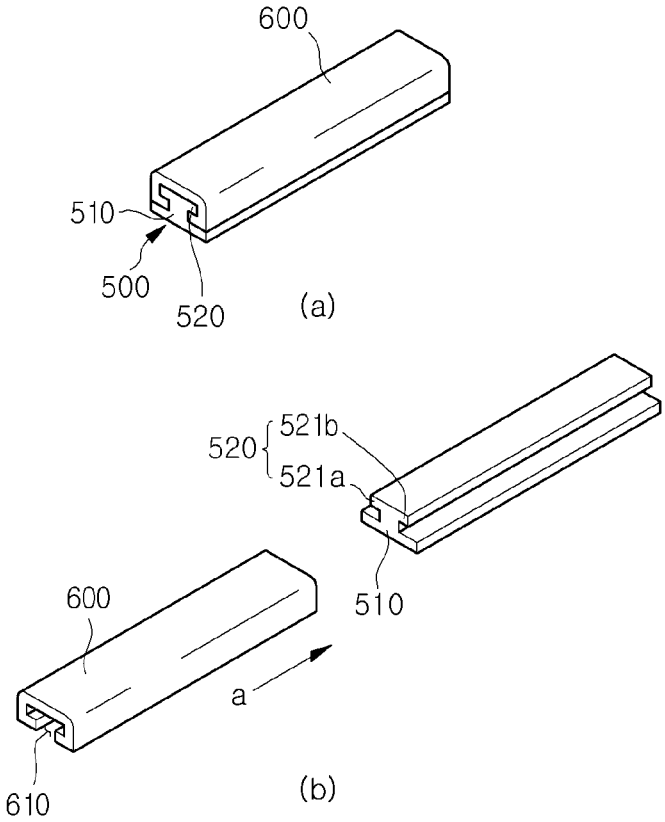
FIG. 5 is a perspective view showing a plurality of lighting units according to the first embodiment.
Figure 6:
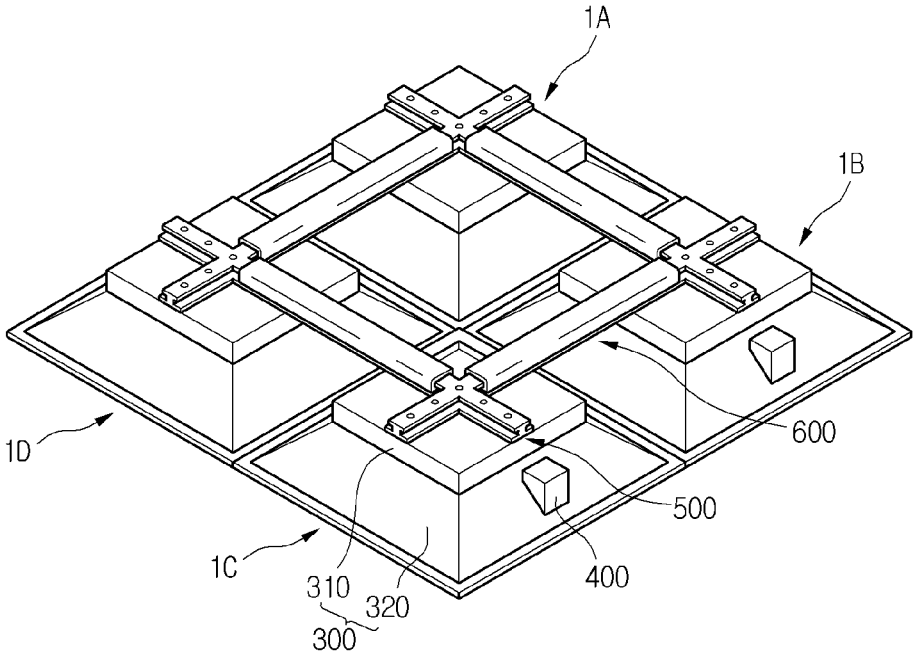
FIG. 6 is a perspective view showing a lighting device assembled with a plurality of lighting units according to the first embodiment.

FIG. 1 is a perspective view showing a lighting unit according to the first embodiment, FIG. 2 is an exploded perspective view showing the lighting unit according to the first embodiment FIG. 3 is a sectional view taken along line A-A' of FIG. 1, FIG. 4 is a plan view showing an exit surface of the lighting unit according to the first embodiment, FIG. 5 is a perspective view showing a plurality of lighting units according to the first embodiment, and FIG. 6 is a perspective view showing the lighting device assembled with a plurality of lighting units according to the first embodiment.

Referring to FIGS. 1 to 6, the light emitting unit 1 according to the embodiment includes a housing 300, a light emitting module 100 installed in the housing 300, an optical sheet part 200 under the light emitting module 100, a power source controller 400 at outer side of the housing 300, and a coupling part 500 on the housing 300.

A plurality of lighting units 1 can be provided and the coupling part 500 of each lighting unit 1 can be coupled with a bracket 600 such that the lighting units 1 can be integrally assembled with each other.

The light emitting module 100 is installed at a front surface of the housing 300 to emit light, and the coupling part 500 is installed at a rear surface of the housing 300 to allow the lighting units 1 to be assembled with each other by the bracket 600.

The housing 300 includes a material having high thermal conductivity to effectively dissipate heat generated from the light emitting module 100 and the power source controller 400. For instance, the housing 300 may include a metallic material or a resin material. The metallic material includes at least one of Al, Cu, Sn, W, Ti, Ag, Au, Pt, Ni, and Zn, without limitation.

In addition, an Al oxide layer or an Ag oxide layer can be formed on the housing 300 to ensure the wear-resistant, erosion-resistant and endurance properties of the housing 300 while improving the aesthetic appearance of the lighting unit 1. Alternatively, the housing 300 can be coated or printed with white color or silver color.

The housing 300 may include a body part 310 and a louver part 320.

The body part 310 may receive the light emitting module 100 and the optical sheet part 200 therein.

When viewed in a plan view, the body part 310 has various shapes, such as a rectangular shape, a circular shape, or a polygonal shape to receive the light emitting module 100 and the optical sheet part 200 therein, but the embodiment is not limited thereto.

The louver part 320 extends around the body part 310. The louver part 320 may be inclined from an outer peripheral surface of the body part 310 by a first inclination angle. The first inclination angle may vary depending on the layout of the lighting unit 1.

The louver part 320 adjusts the orientation angle of the light emitted from the light emitting module 100 and improves light efficiency by reflecting the light. In addition, the louver part 320 attenuates the light glare phenomenon. The power source controller 400 is installed on the louver part 320.

Meanwhile, a concave-convex section is formed on at least apart of the surface of the housing 300 to enlarge the surface area of the housing 300 such that the heat dissipation property of the lighting unit 1 can be improved.

The light emitting module 100 is installed in the body part 310 of the housing 300. The light emitting module 100 may include a substrate 110, and a plurality of light emitting devices 120 formed on a first plane of the substrate 110.

The substrate 110 may include a PCB (printed circuit board). The PCB is obtained by printing circuits on an insulating member and includes an aluminum substrate, a ceramic substrate, a metal core PCB, or a normal PCB.

In order to improve reflective efficiency, the substrate 110 is coated or printed with white color or silver color.

The light emitting devices 120 may include at least one light emitting diode (LED) capable of emitting red, green, blue, white or yellow light. For instance, the light emitting devices 120 may include at least one of a red LED emitting red light, a green LED emitting green light, and a blue LED emitting blue light. In addition, the light emitting devices 120 can be prepared as a combination of LEDs emitting various colors.

The substrate 110 includes circuits capable of driving the light emitting devices 120. The light emitting devices 120 can be mounted on the substrate 110 with various configurations. For instance, the light emitting devices 120 can be mounted on the substrate 110 in the form of a matrix, but the embodiment is not limited thereto. In addition, the number of the light emitting devices 120 may vary depending on the embodiments.

Although not shown in the drawings, a thermal conductive sheet (not shown) can be provided on a second plane of the substrate 110, which is opposite to the first plane of the substrate 110. That is, the thermal conductive sheet is interposed between the substrate 110 and the housing 300.

The optical sheet part 200 is provided under the light emitting module 100. The optical sheet part 200 may include at least one optical sheet. For instance, the optical sheet part 200 includes a diffusion sheet for diffusing the light, a prism sheet for collecting the light, or a fluorescent sheet including a phosphor for changing the wavelength of the light.

The optical sheet can be prepared as a flexible film or a rigid plate by using a synthetic resin material or can be prepared as a glass sheet.

The optical sheet part 200 can collect the light emitted from the light emitting module 100. In addition, the optical sheet part 200 can convert the light into surface light or convert the color of the light, but the embodiment is not limited thereto.

Although the optical sheet part 200 is illustrated as a flat plate shape, the optical sheet part 200 may include a convex surface, a concave surface or a pattern without limitation.

The power source controller 400 is provided at the outer side of the housing 300. The power source controller 400 is electrically connected to the light emitting module 100. The power source controller 400 supplies power to the light emitting module 100 to control or drive the light emitting devices 120 of the light emitting module 100.

As shown in the drawings, the power source controller 400 can be installed at the outer side of the louver part 320 of the housing 300 or at the outer side of the body part 310 of the housing 300 without limitation.

The coupling part 500 is provided on a top surface 312 of the housing 300. The coupling part 500 is coupled with the bracket 600 to assemble a plurality of lighting units 1 with each other.

The coupling part 500 includes a fixing section 510 fixedly coupled with the top surface 312 of the housing 300 and a protrusion section 520 protruding from the fixing part 510. The fixing section 510 extends upward and the protrusion section 520 extends horizontally from the end of the fixing part 510.

The fixing section 510 has first holes 511 and insertion holes 313 are formed in the top surface 312 of the housing 300. Coupling screws 512 are screw-coupled into the insertion holes 313 through the first holes 511 so that the coupling part 500 is fastened to the housing 300.

Referring to FIGS. 5 and 6, the protrusion section 520 has a shape corresponding to a shape of an insertion part 610 of the bracket 600 such that the protrusion section 520 can be fixedly inserted into the insertion section 610 of the bracket 600.

For instance, both sides 521*a* and 521*b* of the protrusion section 520 may protrude in the horizontal direction, but the embodiment is not limited thereto.

The bracket 600 is slidably fitted with the protrusion section 520 in such a manner that the bracket 600 surrounds the protrusion section 520.

Referring again to FIGS. 1 and 2, the coupling part 500 may have across structure having a first section extending in a first direction and a second section extending in a second direction perpendicular to the first direction. In addition, the coupling part 500 may have a linear structure, but the embodiment is not limited thereto.

Hereinafter, the assembling process of the light emitting units 1 will be described with reference to FIGS. 5 and 6.

FIG. 5A is a perspective view showing the coupling part 500 assembled with the bracket 600, and FIG. 5B is a perspective view showing the coupling part 500 disassembled from the bracket 600.

The bracket 600 is slidably coupled with the coupling part 500 in the first direction (a). That is, after aligning the insertion holes 610 of the bracket 600 in line with the protrusion 520 of the coupling part, the bracket 600 is slidably coupled with the coupling part 500 in the first direction (a). The embodiment does not limit the coupling method between the bracket 600 and the coupling part 500.

FIG. 6 is a perspective view showing a lighting device assembled with a plurality of lighting units according to the first embodiment. Although first to fourth lighting units 1A, 1B, 1C and 1D are shown in FIG. 6 for the purpose of explanation, the number of the lighting units may vary depending on the installation position, the installation area and the installation environment.

According to the embodiment, louver sections 320 of the lighting units 1A, 1B, 1C and 1D make contact with each other, so that a gap is not formed among the lighting units 1A, 1B, 1C and 1D.

If the coupling part 500 has a cross structure including a first section extending in a first direction and a second section extending in a second direction perpendicular to the first direction, the coupling part 500 is installed on each of the lighting units 1A, 1B, 1C and 1D in the first and second directions. In addition, adjacent coupling parts 500 are coupled with each other by the brackets 600 so that the lighting units 1A, 1B, 1C and 1D are assembled with each other. The bracket 600 extends from the center of one coupling part 500 of the lighting units 1A, 1B, 1C and 1D to the center of another coupling part 500 of the lighting units 1A, 1B, 1C and 1D.

That is, the coupling parts 500 installed between first and second lighting units 1A and 1B, between second and third lighting units 1B and 1C, between third and fourth lighting units 1C and 1D, and between fourth and first lighting units 1D and 1A are coupled with each other by the brackets 600, thereby providing the lighting device.

The embodiment can provide the lighting device which can be easily assembled or disassembled by the coupling part 500 and the bracket 600.

In addition, the embodiment can provide the lighting device assembled in various layouts by the coupling part 500 and the bracket 600 such that the lighting device may have various areas suitable for various installation environments.

Hereinafter, a lighting device according to the second embodiment will be described in detail. In the following description, the elements and structures that have been described in the first embodiment will be omitted in order to avoid redundancy.

Figure 7:
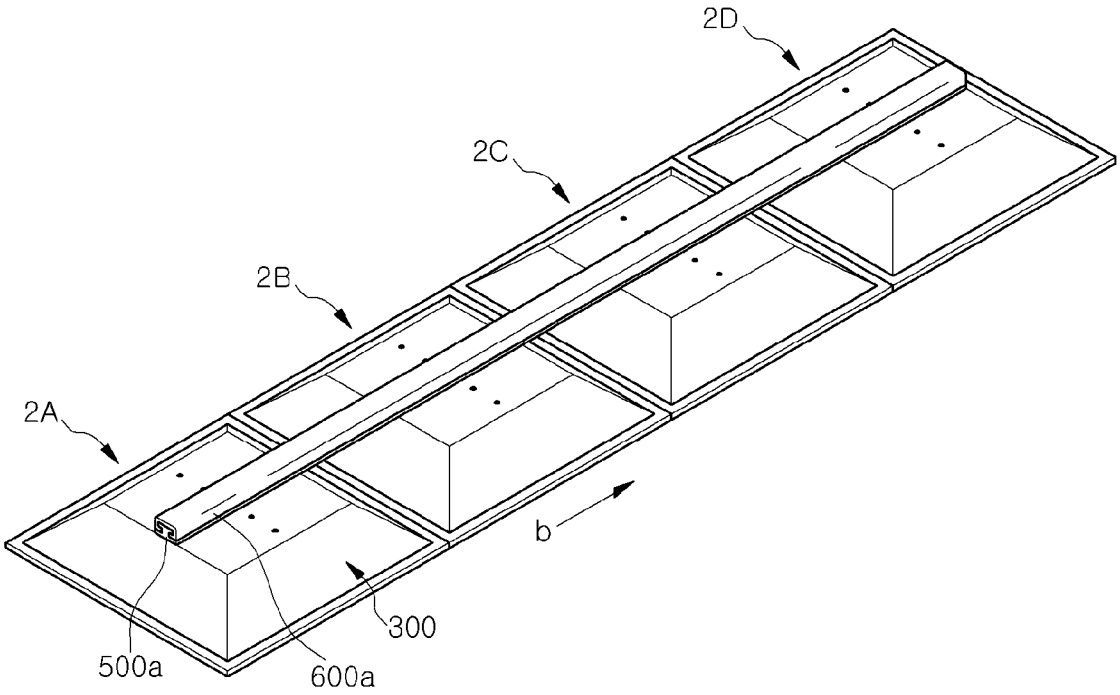
FIG. 7 is a perspective view showing a lighting device assembled with a plurality of lighting units according to the second embodiment.

FIG. 7 is a perspective view showing a lighting device assembled with a plurality of lighting units according to the second embodiment Each lighting unit 2 includes a housing 300, a light emitting module (not shown) installed in the housing 300, an optical sheet section (not shown) installed in the housing 300, a power source controller (not shown) at the outer side of the housing 300, and a coupling part 500*a* on the housing 300.

The coupling parts 500*a* of the light units 2 are coupled with a bracket 600*a* to provide the light device.

The coupling part 500*a* is linearly installed on the top surface of the housing 300 along the second direction (b).

The bracket 600*a* is slidably coupled with the coupling part 500*a* in the second direction (b).

For instance, when the lighting units 2 include first to fourth lighting units 2A to 2D, the coupling parts 500*a* of the first to fourth lighting units 2A to 2D are aligned in line with each other in the second direction (b). In addition, the bracket 600*a* is slidably coupled with the coupling parts 500*a* in the second direction (b). Although only one bracket 600*a* is shown in FIG. 7, a plurality of brackets 600*a* can be provided.

The embodiment does not limit the coupling method between the bracket 600*a* and the coupling part 500*a*. In addition, the number of the lighting units 2 may vary depending on the installation position, installation area and installation environment, and the embodiment is not limited thereto.

Hereinafter, the lighting device according to the third embodiment will be described in detail. In the following description, the elements and structures that have been described in the first embodiment will be omitted in order to avoid redundancy.

Figure 8:
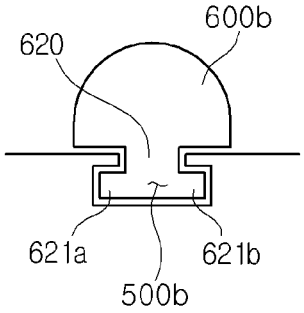
FIG. 8 is a sectional view showing a coupling part and a bracket of a lighting unit according to the third embodiment.

FIG. 8 is a sectional view showing a coupling part 500*b* and a bracket 600*b* of the lighting unit according to the third embodiment;

The lighting device according to the third embodiment is identical to the lighting device according to the first embodiment, except for the structure of the coupling part 500*b* and the bracket 600*b*.

The coupling part 500*b* is formed in the top surface of the housing in the form of a recess extending in the first direction.

The bracket 600*b* includes a bracket body and a protrusion 620 protruding downward from the bracket body. Both sides 621*a* and 612*b* of the lower end of the protrusion 620 protrude horizontally from the protrusion 620.

The shape of the coupling part 500*b* corresponds to the shape of the protrusion 620 of the bracket 600*b*.

The bracket 600*b* can be slidably coupled with the coupling part 500*b* in the first direction, but the embodiment is not limited thereto.

Hereinafter, the lighting device according to the fourth embodiment will be described in detail. In the following description, the elements and structures that have been described in the first embodiment will be omitted in order to avoid redundancy.

Figure 9:
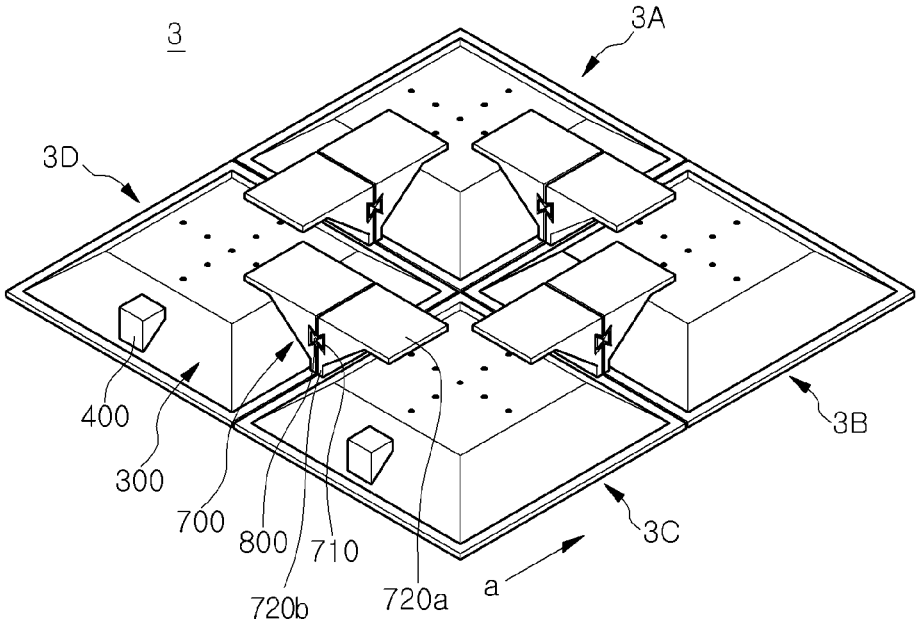
FIG. 9 is a perspective view showing a lighting device assembled with a plurality of lighting units according to the fourth embodiment.
Figure 10:
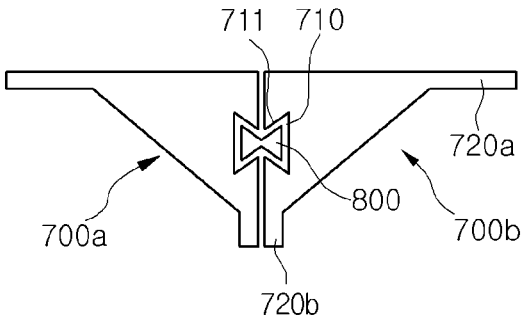
FIG. 10 is a sectional view showing a coupling state between a coupling member and a coupling bar of a lighting unit according to the fourth embodiment.

FIG. 9 is a perspective view showing the lighting device assembled with a plurality of lighting units 3 according to the fourth embodiment, and FIG. 10 is a sectional view showing a coupling state between a coupling member 700 and a coupling bar 800 of the lighting unit according to the fourth embodiment.

Referring to FIGS. 9 and 10, the lighting unit 3 includes a housing 300, a light emitting module (not shown) installed in the housing 300, an optical sheet section (not shown) installed in the housing, and a power source controller 400 at an outer side of the housing 300.

The lighting units 3 are coupled with each other by the coupling member 700 and the coupling bar 800 to provide the lighting device.

The coupling member 700 is provided at an outer surface of the housing 300. For instance, the coupling member 700 is disposed at a lateral side of the housing 300 and includes a first fixing part 720*a* coupled with the top surface of the housing 300, a second fixing part 720*b* coupled with the lateral side of the housing 300 and an insertion hole 710 coupled with the coupling bar 800.

The first and second fixing parts 720*a* and 720*b* have first and second holes (not shown), respectively, and first and second grooves (not shown) are formed at the top surface and lateral side of the housing 300, respectively. Fastening screws (not shown) are screw coupled into the first and second grooves of the housing 300 through the first and second holes of the first and second fixing parts 720*a* and 720*b*, so that the coupling member 700 is fastened to the housing 300, but the embodiment is not limited thereto.

The insertion hole 710 is formed at the lateral side of the coupling member 700 and has a shape corresponding to a shape of the coupling bar 800. An inner wall 711 of the insertion hole 710 is inclined to securely fasten the coupling member 800.

The coupling bar 800 extends in the first direction and has a sectional shape of a ribbon. However, the embodiment may not limit the shape of the coupling bar 800.

Referring to FIG. 10, the insertion holes 710 of two adjacent coupling members 700 may form a coupling hole corresponding to the coupling bar 800 and the coupling bar 800 is inserted into the coupling hole to assemble the lighting units 3 with each other.

The number and layout of the lighting units may vary depending on the installation position, the installation area and the installation environment, and the embodiment is not limited thereto.

The embodiments can provide a lighting device having a novel structure.

The embodiments can provide a lighting device which can be easily assembled and disassembled.

The embodiments can provide a lighting device assembled in various layouts such that the lighting device may have various areas suitable for various installation environments.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a plurality of lighting units including a housing, a light emitting module installed in the housing, and a coupling part having a fixing section coupled on the housing and a protrusion section horizontally protruding from an upper end of the fixing section, the housing including a body part and a louver part inclined from the body part;

a bracket having an insertion groove slidably coupled with the protrusion section of the coupling part to assemble the lighting units with each other; and an optical sheet section on the light emitting module, wherein the light emitting module contacts an inner surface of the body and the coupling part contacts an external surface of the body.

2. The lighting device of claim 1, wherein the coupling parts of the lighting units are linearly disposed and the bracket is coupled with the coupling parts of the lighting units.

3. The lighting device of claim 1, wherein the coupling parts of the lighting units are disposed in a cross pattern and the bracket extends from a center of the coupling part of one lighting unit to a center of the coupling part of another lighting unit.

4. The lighting device of claim 1, wherein the louver part of one lighting unit makes contact with the louver part of another lighting unit.

5. The lighting device of claim 1, further comprising a power source controller installed on the louver part.

6. The lighting device of claim 1, wherein the light emitting module includes a substrate and a plurality of light emitting devices installed on the substrate.

7. The lighting device of claim 6, further comprising a thermal conductive sheet interposed between the substrate and the housing.

8. The lighting device of claim 6, wherein the light emitting device includes a light emitting diode that emits light having a color including at least one of red, green, blue, white and yellow.

9. The lighting device of claim 1, wherein the optical sheet section includes at least one of a diffusion sheet, a prism sheet and a fluorescent sheet.

10. The lighting device of claim 1, wherein the housing includes a metallic material or a resin material.

11. The lighting device of claim 1, wherein the housing is formed thereon with a concave-convex section.

12. The lighting device of claim 1, wherein a width of the protrusion section is smaller than a width of the fixing section.

13. The lighting device of claim 1, wherein a width of the bracket is identical to a width of the fixing section.

14. The lighting device of claim 1, wherein the lighting units are aligned to contact the circumferences of the louver parts each other.

15. The lighting device of claim 1, wherein the louver part is inclined from an edge of the body corresponding to the optical sheet.

16. A lighting device comprising:

a plurality of lighting units including a housing, a light emitting module installed in the housing, and a coupling member coupled with the housing and having an insertion groove, the housing including a body part and a louver part inclined from the body part;

a coupling bar inserted into an insertion hole, which is defined by insertion grooves of two adjacent coupling members of the lighting units; and an optical sheet section on the light emitting module, wherein the light emitting module contacts an inner surface of the body and the coupling part contacts an external surface of the body.

17. The lighting device of claim 16, wherein the coupling member is disposed at a lateral side of the lighting unit and the insertion groove is formed at a lateral side of the coupling member.

18. The lighting device of claim 16, wherein the coupling bar has a sectional shape of a ribbon.

19. The lighting device of claim 16, wherein the light emitting module includes a substrate and a plurality of light emitting devices mounted on the substrate, and the light emitting device includes a light emitting diode that emits light having a color including at least one of red, green, blue, white and yellow.

20. The lighting device of claim 16, wherein the louver part is inclined from an edge of the body corresponding to the optical sheet.

* * * * *